US010392207B2

(12) United States Patent
Kanemaru

(10) Patent No.: US 10,392,207 B2
(45) Date of Patent: Aug. 27, 2019

(54) MEDIUM FEED APPARATUS AND RECORDING APPARATUS

(71) Applicant: SEIKO EPSON CORPORATION, Tokyo (JP)

(72) Inventor: Shinji Kanemaru, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/922,465

(22) Filed: Mar. 15, 2018

(65) Prior Publication Data

US 2018/0282083 A1 Oct. 4, 2018

(30) Foreign Application Priority Data

Apr. 3, 2017 (JP) ..... 2017-073820

(51) Int. Cl.
*B65H 1/02* (2006.01)
*B65H 3/06* (2006.01)
*B65H 3/66* (2006.01)

(52) U.S. Cl.
CPC ..... *B65H 1/02* (2013.01); *B65H 3/0661* (2013.01); *B65H 3/66* (2013.01); *B65H 2405/2111* (2013.01); *B65H 2405/321* (2013.01); *B65H 2405/324* (2013.01); *B65H 2515/81* (2013.01)

(58) Field of Classification Search
CPC . B65H 1/02; B65H 1/027; B65H 1/04; B65H 2405/324
See application file for complete search history.

(56) References Cited

U.S. PATENT DOCUMENTS

| | | | | |
|---|---|---|---|---|
| 9,254,972 | B2 * | 2/2016 | Ukai | B65H 1/04 |
| 9,802,772 | B2 * | 10/2017 | Sai | B65H 1/04 |
| 9,969,585 | B2 * | 5/2018 | Oki | B65H 18/10 |
| 2008/0111875 | A1 * | 5/2008 | Nagashima | B41J 11/0025 347/104 |
| 2012/0242034 | A1 * | 9/2012 | Suzuki | B41J 13/103 271/162 |
| 2013/0164064 | A1 * | 6/2013 | Matsumoto | B65H 1/04 399/361 |
| 2015/0274451 | A1 | 10/2015 | Ukai | |
| 2015/0290955 | A1 * | 10/2015 | Oki | B65H 18/10 242/528 |

FOREIGN PATENT DOCUMENTS

| | | | |
|---|---|---|---|
| JP | 2002-037460 | A | 2/2002 |
| JP | 2006-143373 | A | 6/2006 |
| JP | 2015-147669 | A | 8/2015 |
| JP | 2015-189573 | A | 11/2015 |

* cited by examiner

*Primary Examiner* — Patrick Cicchino
(74) *Attorney, Agent, or Firm* — Workman Nydegger

(57) ABSTRACT

A medium feed apparatus includes a first support face and a second support face. The first support face supports a medium fed by a feed unit that feeds medium by supporting such that the medium adopts an inclined orientation. The second support section is positioned upstream of the first support face in a feed direction, and supports the medium together with the first support face. The second support face is at a position set back from the first support face, and an angle of inclination from a lower end portion to an upper end portion of the second support face is steeper than an angle of inclination of the first support face.

7 Claims, 12 Drawing Sheets

MEDIUM FEED APPARATUS AND RECORDING APPARATUS

BACKGROUND

1. Technical Field

The present invention relates to a medium feed apparatus that feeds a medium, and a recording apparatus equipped with the same.

2. Related Art

Recording apparatuses, which are typically fax machines, printers, or the like, include a feed apparatus (auto sheet feeder) capable of setting plural sheets of recording paper, serving as a medium, to an inclined orientation. The feed apparatus includes a feeder roller, a hopper, and a separating unit. The hopper is capable of changing between a state in which the recording paper is pressed against the feeder roller and a state in which the recording paper is separated from the feeder roller, while supporting the recording paper. The separating unit separates a topmost sheet of recording paper from the next sheet of the recording paper onwards to feed the topmost sheet of recording paper by contacting the recording paper with the feeder roller.

Sometimes a guide (also referred to as a paper support) extending obliquely above a support face with which the hopper supports the recording paper is provided to the feed apparatus. Such a guide is provided so as to be capable of being attached to and detached from the feed apparatus, or configured to be pulled from the feed apparatus when used, and is provided so as to be removed from or stored inside the feed apparatus when not in use.

Hereafter, in the hopper, one face supporting the recording paper will be referred to as a first support face, and a face that supports the recording paper higher up will be referred to as a second support face.

The first support face and the second support face both have a predetermined angle of inclination; however, in related feed apparatuses, there are cases in which the first support face and the second support face are formed with the same angle of inclination, as in JP-A-2006-143373 (case 1), cases in which the angle of inclination of the second support face is formed so as to be more upright than the first support face, as in JP-A-2002-037460 (case 2), and cases in which the angle of inclination of the second support face lies flatter than the first support face, as in JP-A-2015-189573 (case 3).

The first support face and the second support face define the angle at which the recording paper enters between the feeder roller and the separating unit, and so the angle of inclination is of utmost importance from the perspective of preventing non-feeding and double feeding.

Recording paper here includes postcards and the like having high rigidity, and normal paper and the like having low rigidity. Recording paper having low rigidity follows the angle of the first support face and the second support face, and readily adopts the intended inclined orientation. However, recording paper having high rigidity does not readily follow the angle of the first support face and the second support face, and thus does not readily adopt the intended inclined orientation.

For example, when recording paper having high rigidity is set in a configuration in which the first support face and the second support face are set with the same angle of inclination as in case 1, if the recording paper is deformed so as to be bent toward an upper side, only a trailing edge of the recording paper contacts the second support face and the inclined orientation of the recording paper becomes a steep angle. As a result, there is concern that the angle at which paper enters into a nipped position between the feeder roller and the separating unit might become a steeper angle than the preferred angle such that appropriate feeding cannot be performed, making non-feeding particularly liable to occur.

Moreover, in configurations in which the second support face forms a more upright angle of inclination than the first support face, as in case 2, there is concern that, not only in cases in which deformed recording paper is set, but also in cases in which un-deformed recording paper is set, the paper might contact the second support face at the trailing edge only, such that the inclined orientation of the recording paper becomes a steep angle similar to in case 1, and appropriate feeding cannot be performed.

When the second support face is configured so as to form an angle of inclination that lies flatter than the first support face, as in case 3, a paper support forming the second support face adopts a state protruding to the apparatus rear side, necessitating a larger installation space at the rear of the apparatus.

SUMMARY

An advantage of some aspects of the invention is that a medium feed apparatus and a recording apparatus equipped with the same form an appropriate paper orientation regardless of recording paper rigidity and also takes suppression of the apparatus installation space into consideration.

A medium feed apparatus according to a first aspect of the invention includes a feed unit, a first support section, and a second support section. The feed unit feeds a medium. The first support section forms a first support face supporting a medium fed by the feed unit such that the medium adopts an inclined orientation. The second support section is positioned upstream of the first support face in a feed direction, and forms a second support face supporting the medium together with the first support face. The second support face is at a position set back from the first support face, and an angle of inclination of the second support face from a lower end portion to an upper end portion of the second support face is larger than an angle of inclination of the first support face.

In this case, the second support face is positioned upstream of the first support face in the feed direction, in a state in which a step is formed between the first support face and the second support face. Thus, when medium having high rigidity is set, a trailing edge portion of the medium is not liable to contact the second support face, enabling the inclined orientation of the medium to be an orientation that follows the first support face, and thereby enabling appropriate feeding to be realized.

Note that medium having low rigidity readily follows both the first support face and the second support face, and the entry angle of the medium downstream from the first support face is appropriately defined by the first support face, enabling good feeding results to be obtained.

Moreover, the angle of inclination of the second support face is steeper than that of the first support face, enabling the installation space needed at the apparatus rear side to be suppressed.

This aspect thereby enables an appropriate medium orientation to be formed regardless of the rigidity of the medium, and enables the installation space of the apparatus to be suppressed.

Configuration may be made in which the second support face is at a position contacted by a trailing edge of a first medium when the first medium is placed on the first support face and at a position not contacted by the trailing edge of a second medium when the second medium is placed. Configuration may moreover be made in which a length of the first medium in the feed direction is greater than or equal to a feed direction length of A4 size as defined in ISO 216, and a length of the second medium in the feed direction is less than or equal to a feed direction length of A6 size as defined in ISO 216.

In such a configuration, when the second medium is fed, the trailing edge of the second medium does not contact the second support face. This enables the inclined orientation of the medium to be an orientation that follows the first support face, thereby enabling appropriate feeding to be realized. Note that even in cases in which the second medium deforms and the trailing edge of the second medium contacts the second support face, a resulting change in the inclined orientation of the medium can be suppressed, thereby enabling appropriate feeding to be realized.

Configuration may be made in which a connecting face is formed connecting the first support face and the second support face together.

In such a configuration, the connecting face is formed connecting the first support face and the second support face together. Thus, when setting a low rigidity medium that is liable to warp, at least a portion of the connecting face can be utilized in addition to the first support face and the second support face to support the medium, namely, the medium can be supported even better.

Configuration may be made in which the connecting face is a face running along a horizontal direction.

In such a configuration, the connecting face is a face running along the horizontal direction, enabling the medium to be supported even better.

Configuration may be made in which an edge guide that guides an edge of a medium forms a shape straddling between the first support face and the connecting face.

In such a configuration, the edge guide that guides an edge of a medium forms a shape straddling between the first support face and the connecting face. The edge guide is thereby easier to grip, further improving ease of operation of the edge guide.

Configuration may be made further including a cover that opens/closes at least above the connecting face, wherein in a state in which the cover is closed, the edge guide restricts the cover from flexing downward above the connecting face.

This configuration further includes the cover that opens/closes at least above the connecting face. In a state in which the cover is closed, the edge guide restricts the cover above the connecting face from flexing downward above the connecting face. This enables deformation of the cover when an external force is applied from above the cover to be suppressed, thereby enabling damage to the cover to be suppressed and enabling an appropriate external appearance of the medium feed apparatus to be maintained.

Configuration may be made in which the second support section is provided to be capable of switching between a stowed state stowed at an apparatus back face side, and a pulled-out state pulled out from the stowed state to support a medium.

In such a configuration, the second support section is provided so as to be capable of switching between the stowed state stowed at the apparatus back face side, and the pulled-out state pulled out from the stowed state to support a medium. This enables the apparatus to be made smaller when in the stowed state.

A recording apparatus of another aspect of the invention includes a recording unit that performs recording on a medium, and the medium feed apparatus of the first aspect configured to feed a medium toward the recording unit.

In such a configuration, the recording apparatus obtains the operation and advantageous effects of the first aspect described above.

Configuration may be made further including an inverting path that is disposed at a lower side of the medium feed apparatus and that inverts a medium. Moreover, configuration may be made in which a connecting region between the first support face and the second support face, and at least a portion of a region occupied by the inverting path, overlap with each other in an apparatus depth direction.

In such a configuration, the inverting path is provided disposed at the lower side of the medium feed apparatus and inverts a medium. The connecting region between the first support face and the second support face, and at least a portion of the region occupied by the inverting path, overlap with each other in the apparatus depth direction. This enables an apparatus depth direction dimension to be suppressed in a configuration that includes the inverting path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
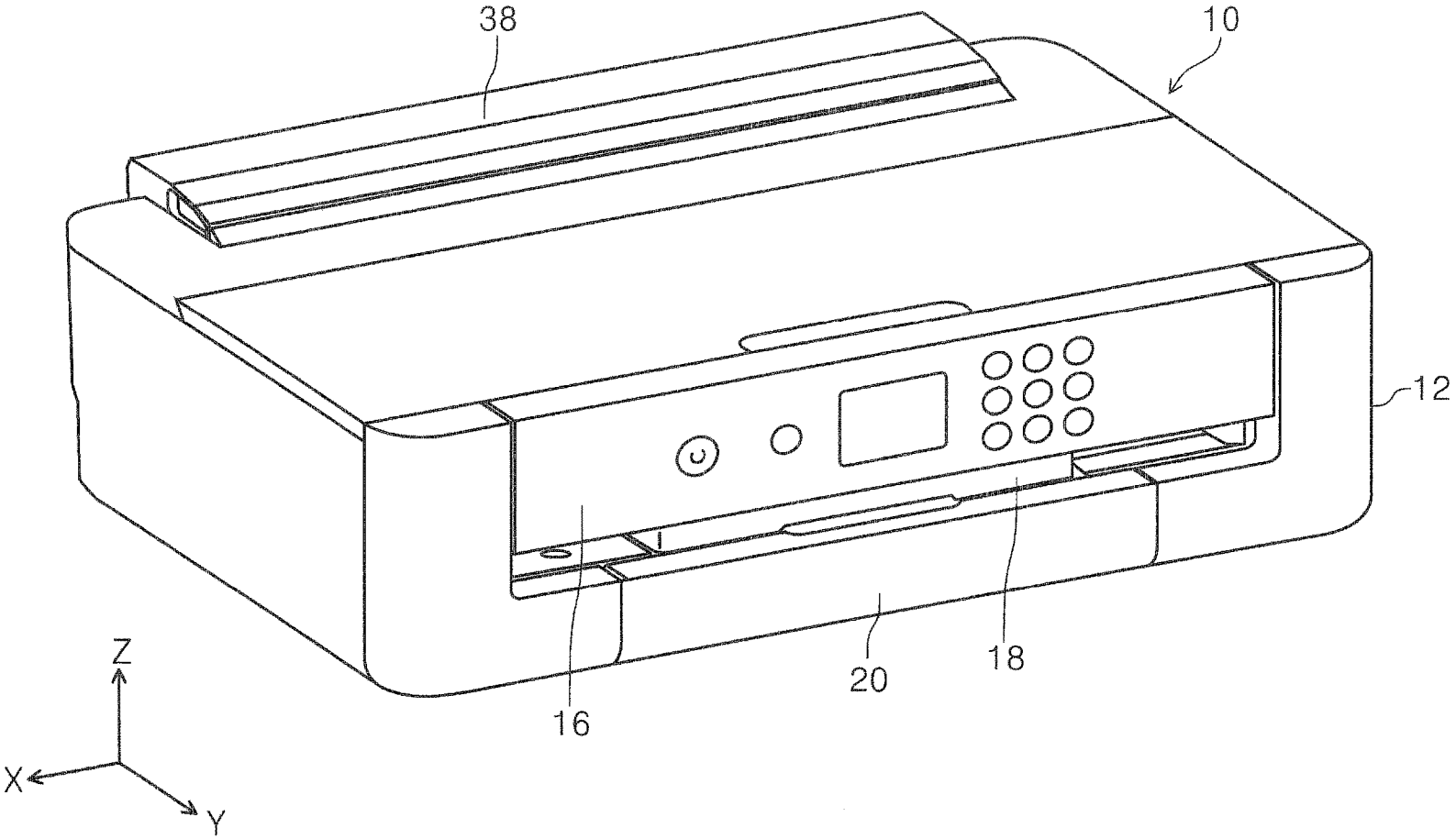
FIG. 1 is an external perspective view of a printer according to the invention.

Explanation follows regarding embodiments of the invention, with reference to the drawings. Note that configurations that are the same for each embodiment are appended with the same reference numerals and are only described in the first embodiment, with description of such configurations being omitted in later embodiments.

Figure 2:
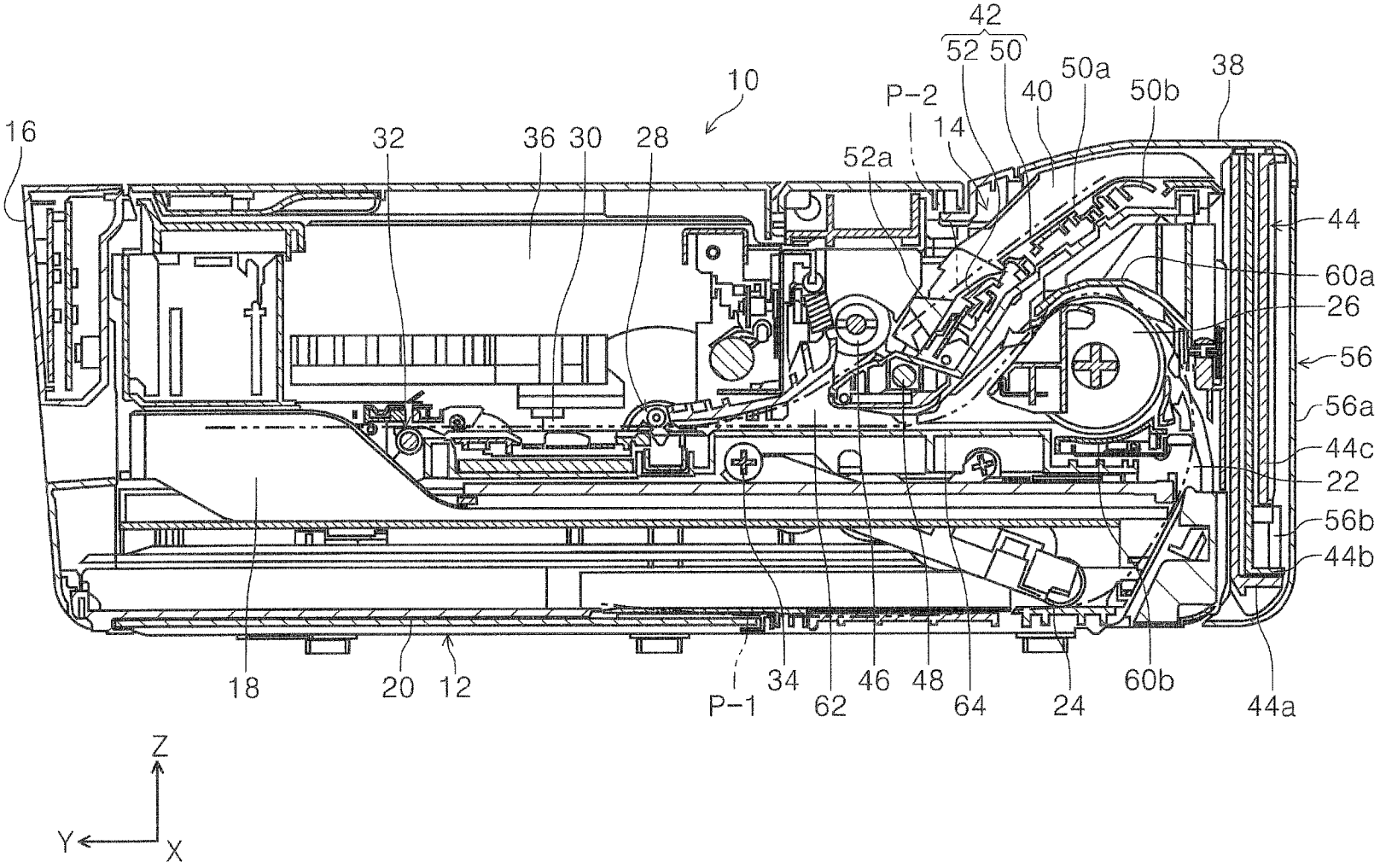
FIG. 2 is a side cross-section illustrating a medium transport path of a printer according to the invention.
Figure 3:
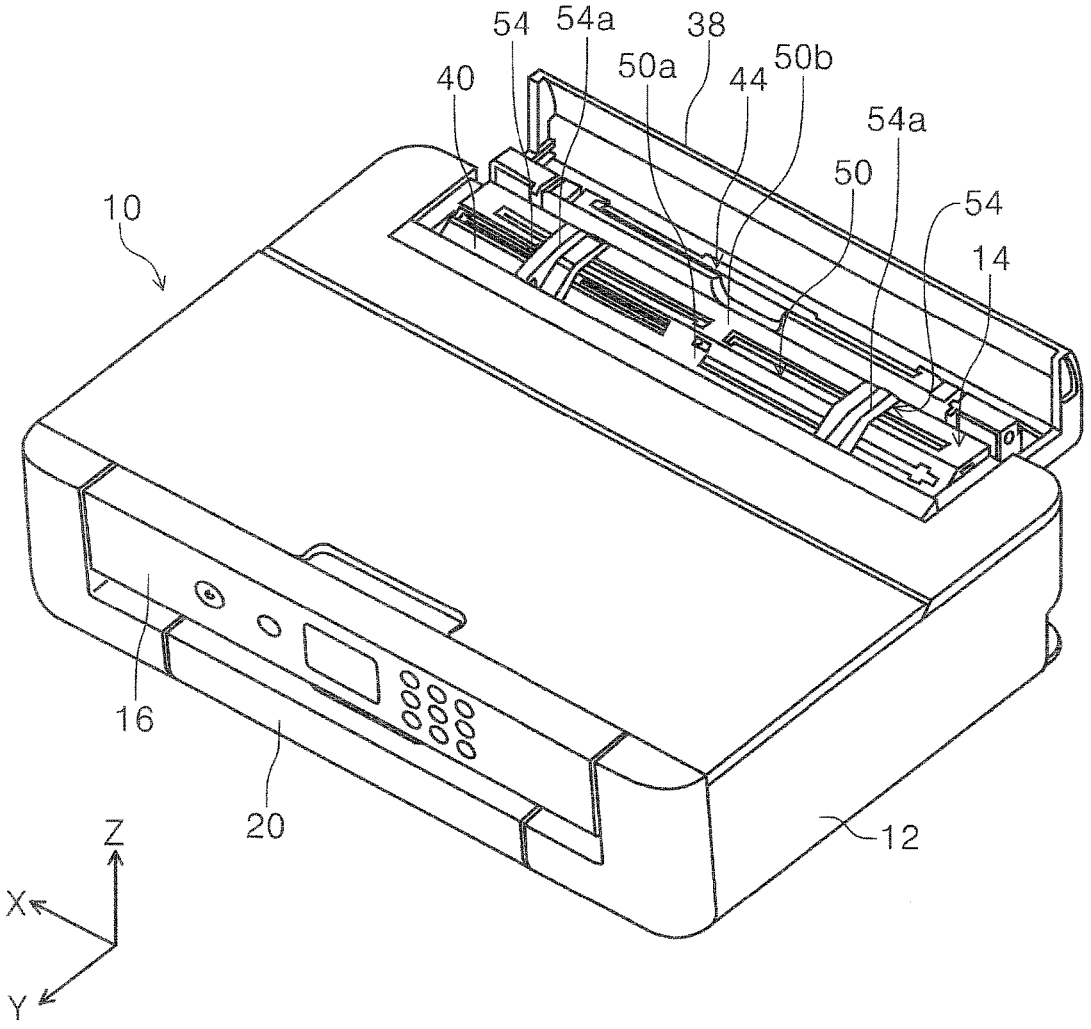
FIG. 3 is an external perspective view of a printer in a state in which a cover is opened.
Figure 4:
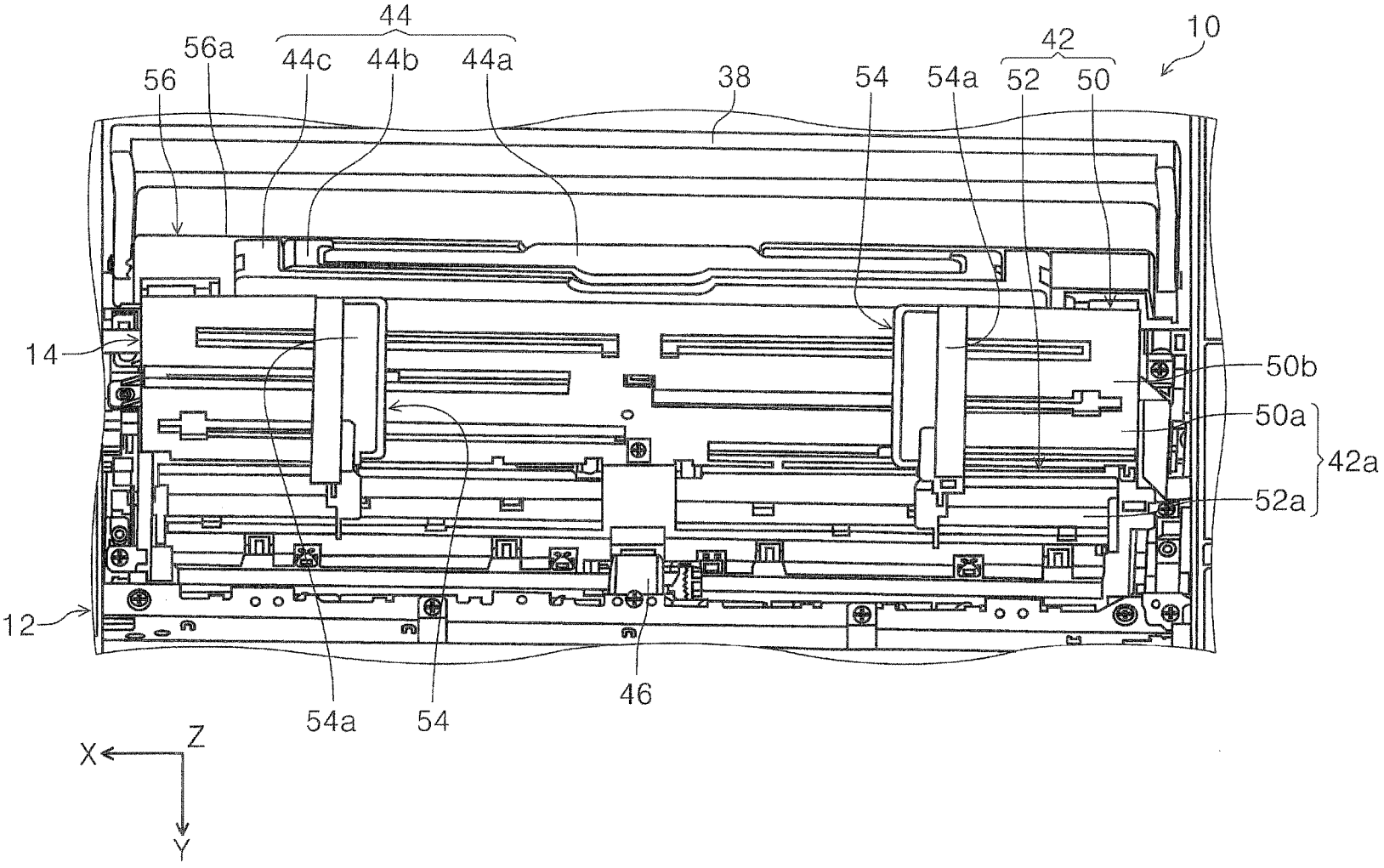
FIG. 4 is a plan view illustrating a first support section and an edge guide in a state in which a cover is opened.

FIG. 1 is an external perspective view of a printer according to the invention. FIG. 2 is a side cross-section illustrating a medium transport path of a printer according to the invention. FIG. 3 is an external perspective view of a printer in a state in which a cover is opened. FIG. 4 is a plan view illustrating a first support section and an edge guide in a state in which a cover is opened.

Figure 5:
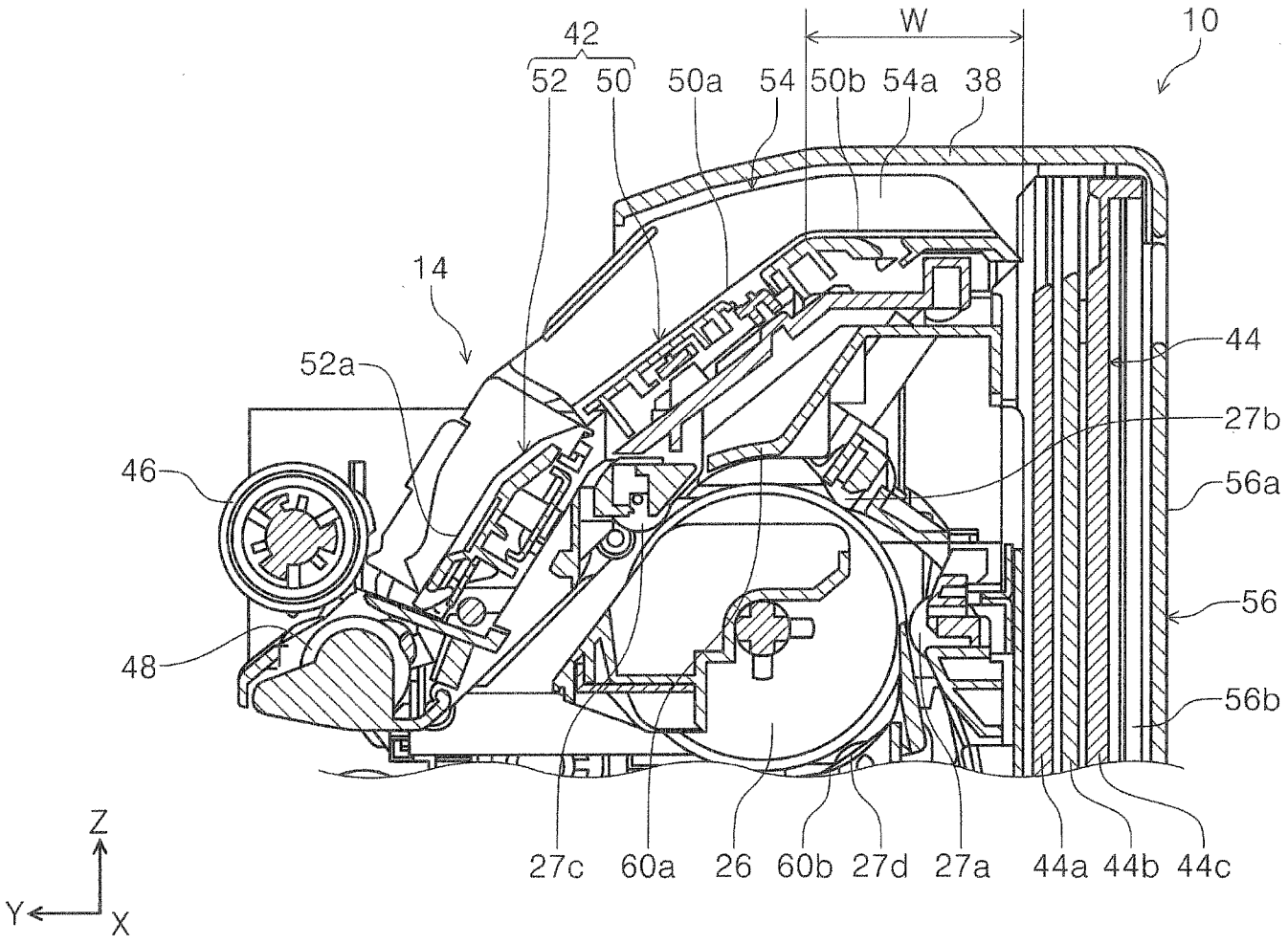
FIG. 5 is a side cross-section of a medium feed apparatus according to the invention.
Figure 6:
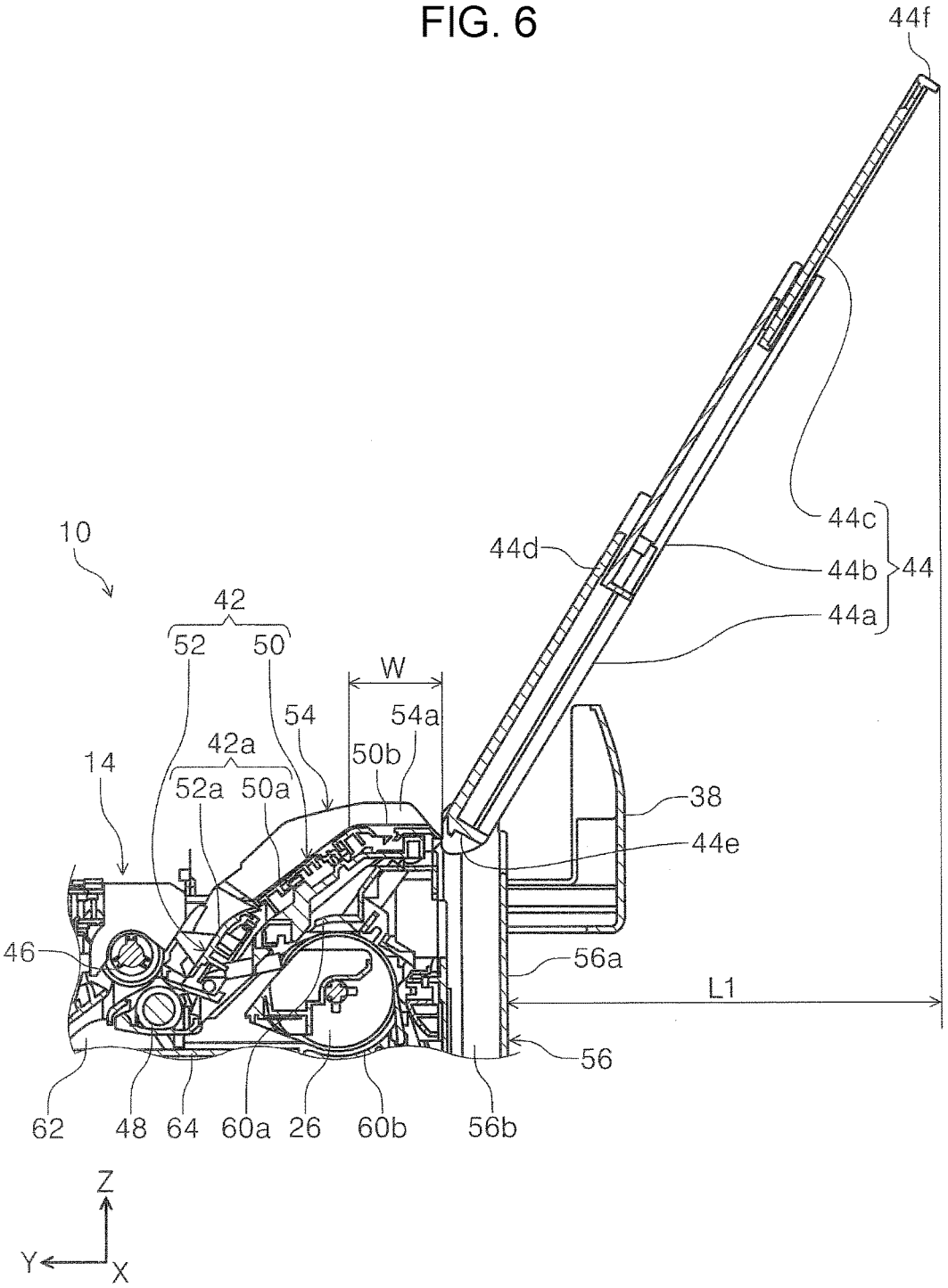
FIG. 6 is a side cross-section illustrating a second support section according to the invention in a pulled-out state.
Figure 7:
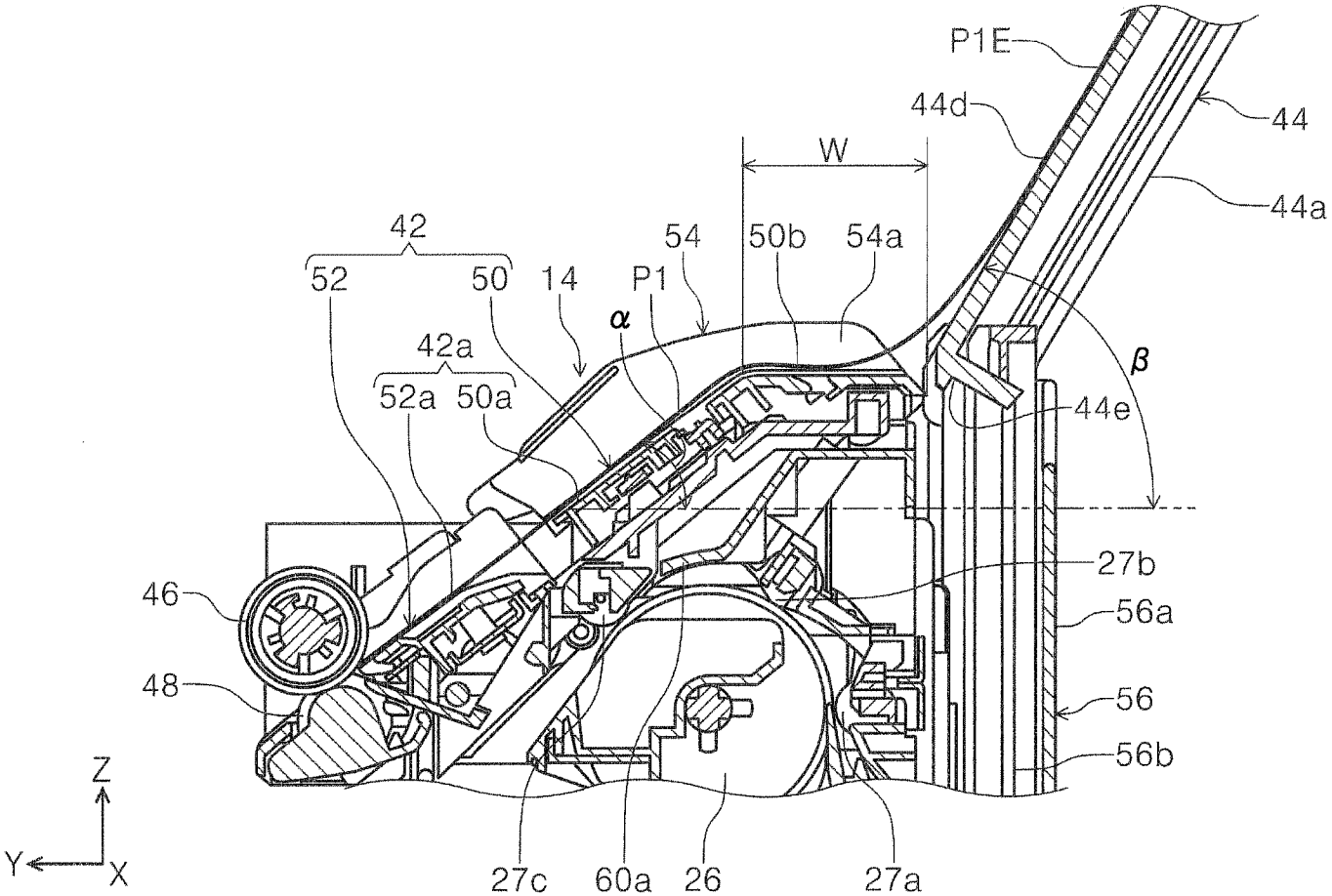
FIG. 7 is a side cross-section illustrating a state in which a first medium has been set in a medium feed apparatus.
Figure 8:
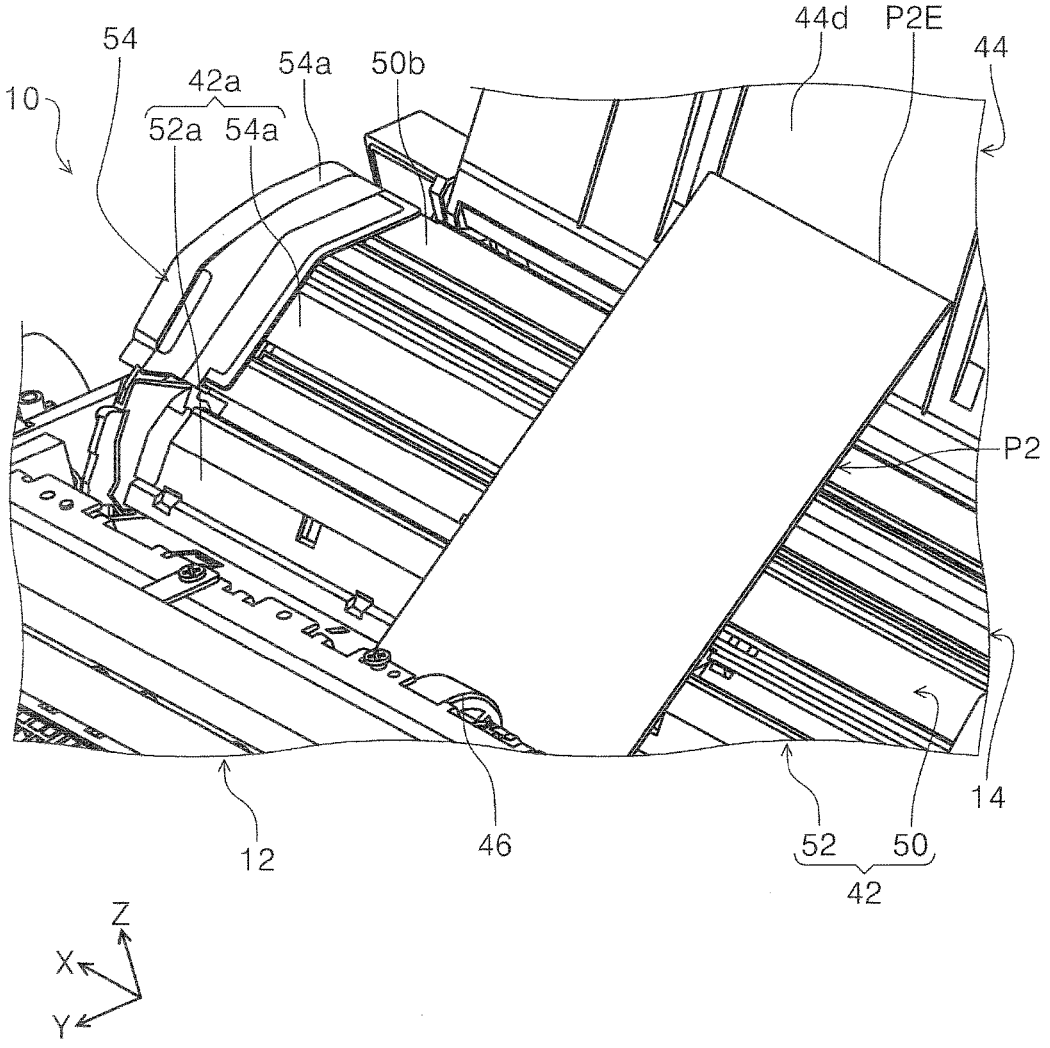
FIG. 8 is a perspective view illustrating a state in which a second medium has been set in a medium feed apparatus.

FIG. 5 is a side cross-section of a medium feed apparatus according to the invention. FIG. 6 is a side cross-section illustrating a second support section according to the invention in a pulled-out state. FIG. 7 is a side cross-section illustrating a state in which a first medium has been set in a medium feed apparatus. FIG. 8 is a perspective view illustrating a state in which a second medium has been set in a medium feed apparatus.

Figure 9:
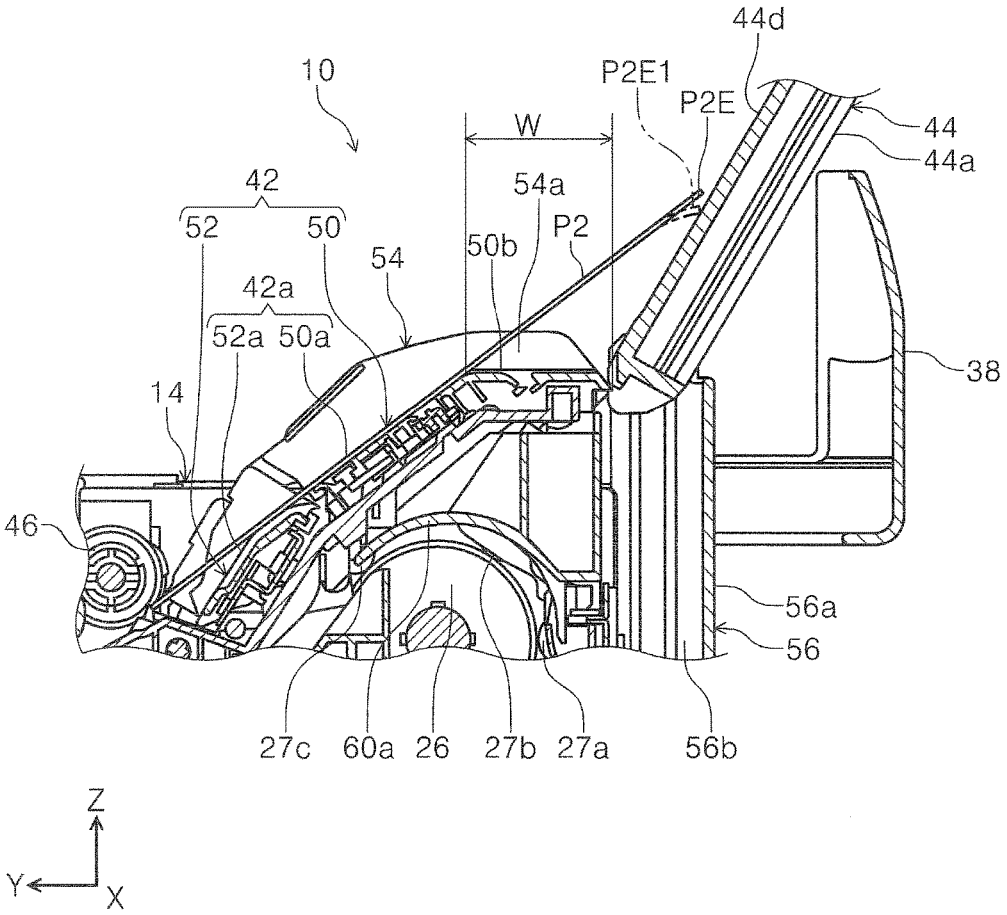
FIG. 9 is a side cross-section illustrating a state in which a second medium has been set in a medium feed apparatus.
Figure 10:
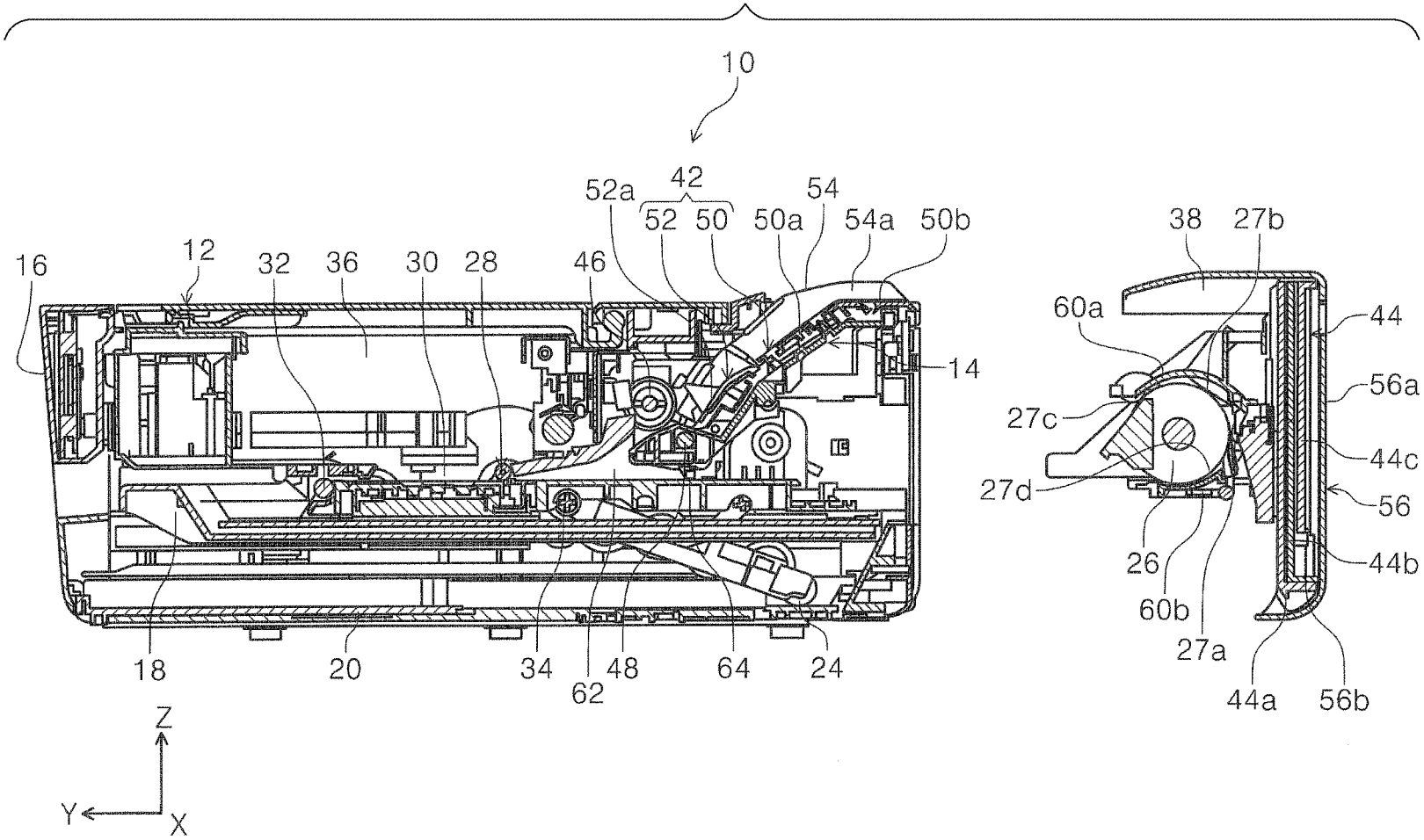
FIG. 10 is a side cross-section illustrating a state in which an inverting path unit has been removed from an apparatus body.
Figure 11:
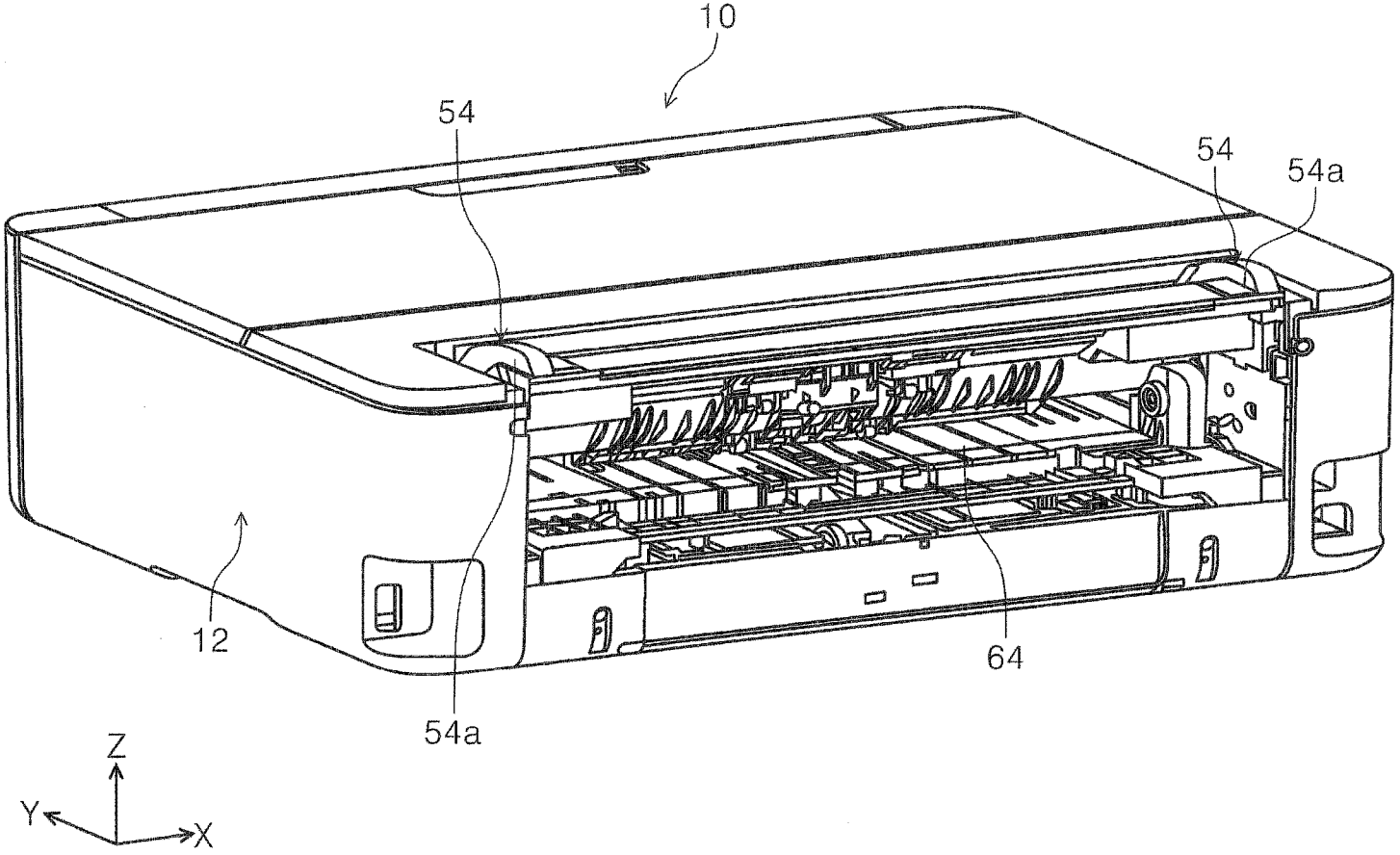
FIG. 11 is a perspective view illustrating a back face of an apparatus body in a state in which an inverting path unit has been removed therefrom.
Figure 12:
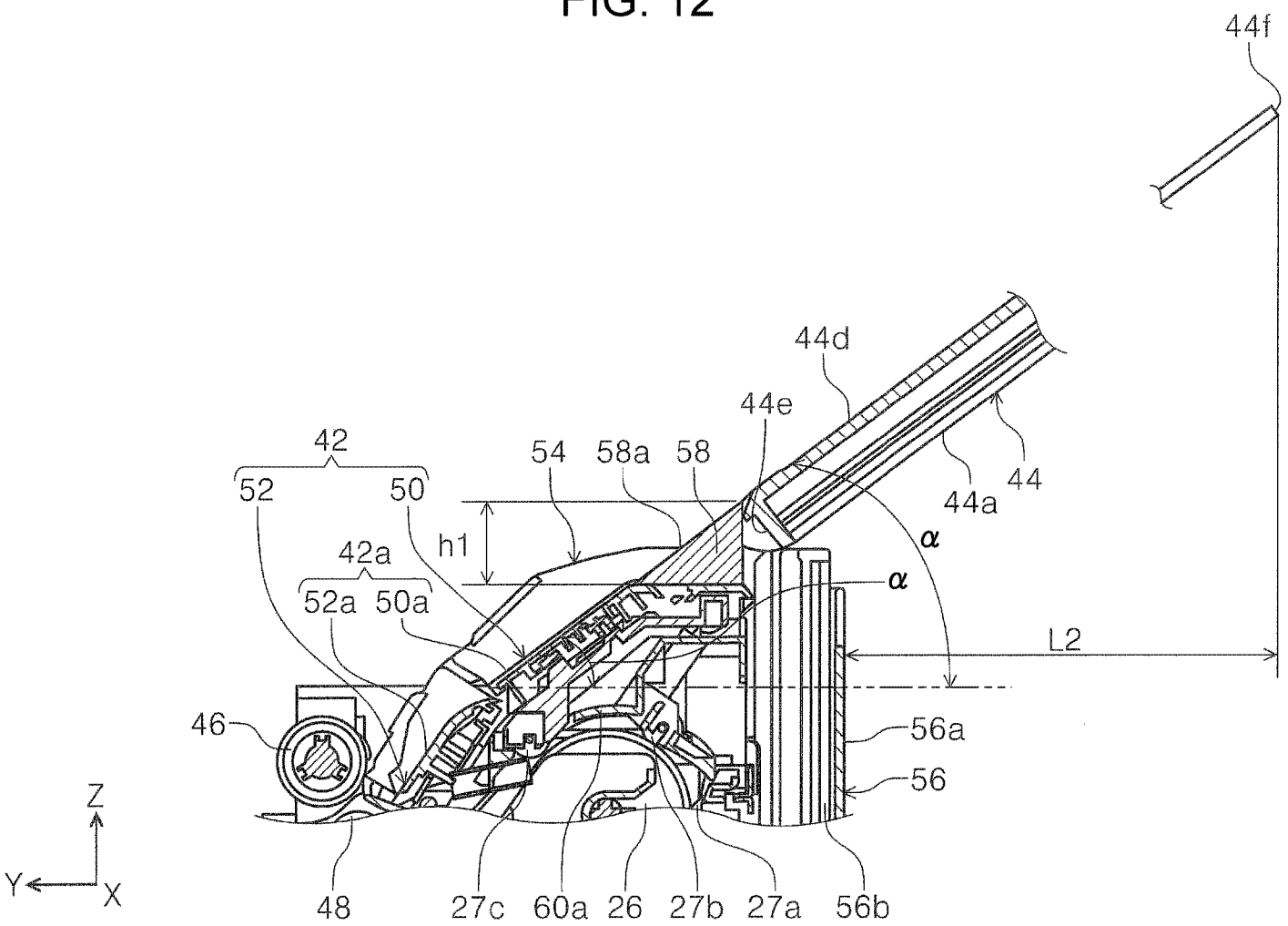
FIG. 12 is a side cross-section for explaining a case in which an angle of inclination of a second support face has been set to the same angle as an angle of inclination of a first support face.

FIG. 9 is a side cross-section illustrating a state in which a second medium has been set in a medium feed apparatus. FIG. 10 is a side cross-section illustrating a state in which an inverting path unit has been removed from an apparatus body. FIG. 11 is a perspective view illustrating a back face of an apparatus body in a state in which an inverting path unit has been removed therefrom. FIG. 12 is a side cross-section for explaining a case in which an angle of inclination of a second support face has been set to the same angle as an angle of inclination of a first support face.

In the X-Y-Z coordinate system illustrated in each of the drawings, the X direction is a recording medium width direction, namely, an apparatus width direction. The Y direction is a direction in which the recording medium is transported along a transport path in a recording apparatus, namely, an apparatus depth direction. The Z direction is an apparatus height direction.

Embodiment

Outline of Printer

Explanation follows regarding overall configuration of a printer 10 illustrated in FIG. 1. The printer 10 serves as an example of a recording apparatus and is configured as an ink jet printer. The printer 10 includes an apparatus body 12, and a medium feed apparatus 14 provided inside the apparatus body 12. An operation section 16 is provided on an apparatus front-face side of the apparatus body 12. The operation section 16 is provided with an operation unit such as a display panel and a switch. A discharge tray 18 is provided in the −Z direction of the operation section 16. The discharge tray 18 is configured so as to be capable of switching between a state stowed in the apparatus body 12 (FIG. 1 and FIG. 2), and a state projecting to the apparatus front-face side in which the discharge tray 18 is opened out to the front-face side of the apparatus body 12 (not illustrated in the drawings).

On the −Z direction side of the discharge tray 18, the apparatus body 12 is provided with a medium storage cassette 20 that stores a medium. In the present embodiment, the medium storage cassette 20 is configured so as to be capable of being attached to or removed from the apparatus body 12, from the front-face side of the apparatus body 12. Note that in the present embodiment, for example, a first medium P1, described later, such as A4 size medium, is stored in the medium storage cassette 20.

The sizes of the media described herein correspond to sizes defined in ISO 216.

Outline of Medium Transport Path

Explanation follows regarding a medium transport path 22 illustrated in FIG. 2. The double-dotted dashed line labeled P-1 in FIG. 2 indicates the path that medium is transported along in the medium transport path 22, from the medium storage cassette 20 to the discharge tray 18. In the apparatus body 12, a pick-up roller 24, an inverting roller 26, a pair of transport rollers 28, a recording head 30 serving as a "recording unit", and a pair of discharge rollers 32 are disposed in sequence along the medium transport path 22.

The pick-up roller 24 is provided on the +Z direction side of the medium storage cassette 20 and is configured so as to be capable of pivoting about a pivot shaft 34. The pick-up roller 24 contacts a medium stored in the medium storage cassette 20, thereby transporting the topmost sheet of medium, out of the medium stored in the medium storage cassette 20, downstream in the transport direction along the medium transport path 22.

In the vicinity of the inverting roller 26, following rollers 27*a*, 27*b*, 27*c*, and 27*d* (FIG. 5) are provided so as to be capable of rotating following the inverting roller 26. Medium fed out from the medium storage cassette 20 is nipped between the inverting roller 26 and the following rollers 27*a*, 27*b*, and 27*c*, in sequence so as to be bent around and inverted, and is fed downstream in the transport direction to the pair of transport rollers 28. The medium fed from the inverting roller 26 is fed by the pair of transport rollers 28 to a region facing the recording head 30. The recording head 30 is provided at a lower portion of a carriage 36 and is configured so as to be capable of discharging ink in the −Z direction. The carriage 36 is configured so as to be capable of moving back and forth in the X axis direction inside the apparatus body 12. The recording head 30 discharges ink onto the medium fed by the pair of transport rollers 28, and records on a recording face of the medium.

The medium that has been recorded on is nipped by the pair of discharge rollers 32 provided downstream of the recording head 30 in the transport direction, and discharged toward the discharge tray 18 projecting at the apparatus front-face side. Note that the double-dotted dashed line labeled P-2 in FIG. 2 indicates a medium transport path of the medium feed apparatus 14 disposed in the +Z direction of the inverting roller 26.

Medium Feed Apparatus

Next, the medium feed apparatus 14 will be described. As illustrated in FIG. 1 and FIG. 3, a cover 38 is provided at an upper portion of a −Y direction side end portion of the apparatus body 12. The cover 38 is configured so as to be capable of switching between a closed state (FIG. 1) and an opened state (FIG. 3) with respect to the apparatus body 12. As illustrated in FIG. 3, when the cover 38 is in the opened state with respect to the apparatus body 12, a feed port 40 (FIG. 2) is placed in an open state, and medium can be inserted into the medium feed apparatus 14 through the feed port 40.

As illustrated in FIG. 4 and FIG. 5, the medium feed apparatus 14 includes a first support section 42 that supports a medium, a second support section 44, a feeder roller 46 serving as a "feed unit", and a separation roller 48. The first support section 42 includes a medium placement portion 50 positioned upstream in the medium transport direction, and a hopper portion 52 positioned downstream in the medium transport direction. The medium placement portion 50 includes a support face 50*a* inclined at an angle of inclination $\alpha$ (FIG. 7) with respect to the Y axis direction, this being the horizontal direction, and a connecting face 50*b* that is connected to the support face 50*a* at an upper end of the support face 50*a* and that extends in the Y axis direction, this being the horizontal direction. Note that the connecting face 50*b* is configured as a flat face extending in the Y axis direction; however, there is no limitation thereto, and the connecting face 50*b* may be a face at a gentler incline than the angle of inclination $\alpha$.

The hopper portion 52 includes a support face 52*a* that supports a medium. The hopper portion 52 is configured so as to be capable of switching between an orientation in which the support face 52*a* is further from the feeder roller 46 (FIG. 5), and an orientation in which the support face 52*a* is closer to the feeder roller 46 (FIG. 7). A transport direction downstream side of the hopper portion 52 is configured so as to be capable of swinging about its transport direction upstream side, and the support face 52*a* is pushed up toward the feeder roller 46 by a non-illustrated biasing unit.

As illustrated in FIG. 7, in the orientation in which the hopper portion 52 is pushed up toward the feeder roller 46 (feed orientation), the support face 50*a* of the medium placement portion 50 and the support face 52*a* of the hopper portion 52 adopt a state forming substantially the same angle of inclination as each other (angle of inclination α) with respect to the Y axis, this being the horizontal direction, and the support face 50*a* and the support face 52*a* configure a first support face 42*a*. The angle of inclination α of the present embodiment is set to a preferable medium entry angle to a nipped position between the feeder roller 46 and the separation roller 48. Note that "substantially the same state" when the hopper portion 52 is in the orientation pushed up toward the feeder roller 46 (feed orientation) refers not only to a state in which the angles of inclination are in perfect alignment, but also includes states in which the angle of inclination of the support face 50*a* and the angle of inclination of the support face 52*a* differ within a permissible range in which the medium supported by the first support face 42*a* is maintained at the angle of inclination α.

As illustrated in FIG. 4 and FIG. 5, a pair of edge guides 54 having shapes straddling between the first support face 42*a* and the connecting face 50*b* are disposed at the first support section 42. The pair of edge guides 54 are configured so as to be capable of moving in directions toward or away from each other in the X axis direction.

As illustrated in FIG. 5, in the closed state of the cover 38, extension portions 54*a*, these being portions of the edge guides 54 that straddle the connecting face 50*b*, are positioned at a −Z direction side of the cover 38. Thus, in the closed state of the cover 38, the cover 38 contacts the extension portions 54*a* of the edge guides 54 above the connecting face 50*b* if a user or the like presses the cover 38 in the −Z direction, and displacement (flexing) of the cover 38 toward the −Z direction side is restricted.

As a result, the cover 38 can be suppressed from deforming beyond a permissible limit, and damage to the cover 38 can be suppressed. Moreover, since the cover 38 can be suppressed from deforming beyond a permissible limit, this enables a reduction in the cover 38 substantial visible deformation in external appearance, and enables the external appearance of the printer 10 to be appropriately maintained.

As illustrated in FIG. 5 and FIG. 6, the second support section 44 is disposed in the −Y direction of the first support section 42. The second support section 44 is configured so as to be capable of switching between a stowed state (FIG. 5) stowed at a −Y direction side end portion 56*a* of an inverting unit 56 (FIG. 10), described later, and a pulled-out state pulled out from the −Y direction side end portion 56*a* of the inverting unit 56 and inclined at an angle of inclination β with respect to the Y axis direction, this being the horizontal direction. In the present embodiment, the second support section 44 is, for example, configured as a multistage telescopic tray. Note that the second support section 44 may be configured as a single stage tray instead of as a multistage tray.

More specifically, the second support section 44 includes a first tray 44*a*, a second tray 44*b*, and a third tray 44*c*. The first tray 44*a* and the second tray 44*b* are configured so as to be capable of sliding with respect to each other. Similarly, the second tray 44*b* and the third tray 44*c* are configured so as to be capable of sliding with respect to each other. The second support section 44 is configured so as to be capable of telescoping in length along the medium transport direction by sliding the trays with respect to each other. Note that FIG. 6 illustrates the second support section 44 with the trays of all three stages in a pulled-out state. However, the second support section 44 may also be employed using a single stage, in a state in which the second tray 44*b* and the third tray 44*c* are stowed in the first tray 44*a*.

In the pulled-out state, the second support section 44 forms a second support face 44*d* inclined at the angle of inclination β. The second support face 44*d* is positioned upstream of the first support face 42*a* in the medium transport direction (feed direction), and supports the medium together with the first support face 42*a*. Note that strictly speaking, the support face that is formed by the trays is staggered by the thickness of each tray in a direction intersecting the slide direction of the respective trays; however, the explanation of the present embodiment treats the faces formed by the trays as being in the same plane as each other.

As illustrated in FIG. 7, when the second support section 44 is in the pulled-out state, the first support face 42*a* is inclined at the angle of inclination α with respect to the Y axis direction, this being the horizontal direction, and the second support face 44*d* is inclined at the angle of inclination β with respect to the Y axis direction, this being the horizontal direction. In the present embodiment, the angle of inclination β is set larger than the angle of inclination α. The second support face 44*d* is thereby inclined at a steeper angle than the first support face 42*a*, from a lower end portion 44*e* of the first tray 44*a* to an upper end portion 44*f* of the third tray 44*c*. Note that as illustrated in FIG. 6, the Y axis direction distance from the lower end portion 44*e* of the second support face 44*d* to the upper end portion 44*f* is set to L1.

Moreover, the second support face 44*d* is provided at a position set back from the first support face 42*a* in the Y axis direction. The connecting face 50*b* extending in the Y axis direction between the first support face 42*a* and the second support face 44*d* and connecting the first support face 42*a* and the second support face 44*d* together is provided in the Y axis direction and forms a connecting region W (FIG. 6 and FIG. 7).

The bold line labeled P1 in FIG. 7 indicates a state in which the first medium P1 is supported by the first support face 42*a*. In FIG. 7, when the first medium P1 is set on the first support section 42 of the medium feed apparatus 14, the first medium P1 is supported by the first support face 42*a*, with a trailing edge P1E of the first medium P1 being supported by the second support face 44*d*. Note that in cases in which the first medium P1 has low rigidity, the first medium P1 is also supported by the connecting face 50*b* in addition to the first support face 42*a* and the second support face 44*d*. In the present embodiment, the first medium P1 is longer than the length of at least the first support face 42*a* along the medium transport direction, and is long enough that the trailing edge P1E is supported by the second support face 44*d*. The first medium P1 is set, for example, as an A4 size medium or a medium that is larger than A4 size, for example, an A3 size medium or the like.

Setting of the Second Medium

Next, a state will be described in which the second medium P2 is set in the medium feed apparatus 14, as is illustrated in FIG. 8 and FIG. 9. In the present embodiment, the second medium P2 is set, for example, as a medium shorter in length in the medium transport direction than the first medium P1. Specifically, the second medium P2 is set as a postcard, or as a medium that has a postcard-sized length in the medium transport direction. An example of a medium having a postcard-sized length serving as the second medium P2 is what is referred to as a lenticular 3D medium in which different graphics can be seen depending on the angle the medium is viewed from. The rigidity of the second medium P2 is higher than the rigidity of the first medium P1. The second medium P2 also includes media that are thicker (more rigid) than the first medium P1. Postcard size corresponds to A6 size as defined by ISO 216 (105 mm×148 mm). Moreover, homemade postcards may also be included (90 to 107 mm×140 to 154 mm).

When the second medium P2 is set on the first support face 42*a* of the medium feed apparatus 14, the second medium P2 is supported by the support face 50*a* of the medium placement portion 50. As illustrated in FIG. 9, the second medium P2 has a shorter medium transport direction length than the first medium P1, and so the second medium P2 adopts a state in which a trailing edge P2E of the second medium P2 does not contact the second support face 44*d* and is not supported by the second support face 44*d*. As a result, the orientation of the second medium P2 follows the support face 50*a* of the medium placement portion 50, such that the second medium P2 is supported by the first support face 42*a* in an orientation angled at the angle of inclination α.

In the present embodiment, the medium feed apparatus 14 is provided with the connecting region W in the Y direction between the first support face 42*a* and the second support face 44*d* such that the trailing edge P2E of the second medium P2 does not contact the second support face 44*d*. For example, the Y direction length of the connecting face 50*b* forming the connecting region W is set to a length at which the trailing edge P2E of the second medium P2 set on the first support face 42*a* does not contact the second support face 44*d*.

Were the trailing edge P2E of the second medium P2 to contact the second support face 44*d*, due to the high rigidity of the second medium P2, the trailing edge P2E might be lifted up such that the second medium P2 does not follow either the first support face 42*a* or the second support face 44*d*, and the orientation of the second medium P2 would therefore be an inclined orientation with a steeper angle than the angle of inclination α.

The medium entry angle of the second medium P2 to the nipped position between the feeder roller 46 and the separation roller 48 would thus be a steeper angle than the preferred angle α, such that appropriate feeding may not be achievable, and non-feeding in particular is liable to occur.

In contrast thereto, in the present embodiment, the Y direction length of the connecting face 50*b* (connecting region W) is set such that the trailing edge P2E of the second medium P2 supported by the first support face 42*a* does not contact the second support face 44*d*, enabling appropriate feeding since even the high-rigidity second medium P2 is supported by the first support face 42*a* at the angle of inclination α and fed to the nipped position between the feeder roller 46 and the separation roller 48 at the preferred angle of entry.

Moreover, for example in a state in which the trailing edge P2E of the second medium P2 is arched back in the −Z direction toward the second support face 44*d* side (deformed state, the double-dotted dashed line portion labeled P2E1 in FIG. 9), the trailing edge P2E might contact the second support face 44*d*. Even in such cases, the amount by which the trailing edge P2E is lifted up by the second support face 44*d* is suppressed, enabling change in the inclined orientation of the second medium P2 to be suppressed and enabling the angle of inclination of the second medium P2 to be set to an angle closer to angle α, thereby enabling appropriate feeding to be performed. Regarding the Significance of Providing the Connecting Region W and of Setting the Angle of Inclination α of the First Support Face and the Angle of Inclination β of the Second Support Face to Different Angles from Each Other Issues that arise in a configuration in which the connecting region W (connecting face 50*b*) is not provided and in which the angle of inclination of the first support face 42*a* and the angle of inclination of the second support face 44*d* are set to the same angle as each other will be described here with reference to FIG. 12 in order to explain the operation and advantageous effects obtained in providing the connecting region W (connecting face 50*b*) between the first support section 42 and the second support section 44, and in setting the angle of inclination β of the second support face 44*d* to a steeper angle than the angle of inclination α of the first support face 42*a*. In FIG. 12, the second support section 44 is configured inclined at the angle of inclination α rather than the angle of inclination β. Moreover, between the support face 50*a* of the medium placement portion 50 and the lower end portion 44*e* of the second support section 44, a connecting portion 58 that joins together the support face 50*a* and the second support face 44*d* is provided instead of the connecting region W.

Although there is no change in the medium transport direction length of the second support face 44*d* from the lower end portion 44*e* to the upper end portion 44*f* of the second support section 44, changing the angle of inclination of the second support section 44 from the angle of inclination β to the angle of inclination α results in the orientation of the second support section 44 in the direction lying flatter toward the Y axis direction. As a result, the second support section 44 projects toward the −Y direction (the apparatus back-face side) from a Y direction side end portion 56*a* by a distance L2. The projection distance L2 is larger than the projection distance L1 toward the −Y direction (apparatus back face side) from the Y direction side end portion 56*a* of the second support section 44 when in an orientation inclined at the angle of inclination β.

When the angle of inclination of the second support section 44 in the pulled-out state is gentle, the projection amount of the second support section 44 toward the apparatus back face becomes accordingly larger, and the size of the printer 10 in the apparatus depth direction becomes larger. As a result, the installation space needed for the printer 10, in particular the installation space needed for the back-face side of the printer 10, becomes larger.

In contrast thereto, in the present embodiment, the angle of inclination of the second support section 44 in the pulled-out state is set to the angle β, which is steeper than the angle α, enabling the projection amount in the apparatus depth direction to be decreased. As a result, the size of the printer 10 in the apparatus depth direction can be made smaller, and the installation space needed for the printer 10, in particular the installation space needed for the apparatus back face side, can be suppressed.

The connecting portion 58 in FIG. 12 is configured as a member including, for example, a connecting face 58*a* so as to join together the support face 50*a* and the second support face 44*d* in the Z axis direction and in the Y axis direction. In FIG. 12, the connecting portion 58 is set, for example, with a Z axis direction height of h1. The position of the cover 38 in the Z axis direction is raised by the height h1 to avoid interference with the connecting portion 58 when attempting to place the second support section 44 in a stored state and close the cover 38. This leads to an increase in the size of the printer 10 in the Z axis direction.

In the present embodiment, the connecting region W is provided between the first support face 42*a* and the second support face 44*d*, and there is no support face to make the first support face 42*a* and the second support face 44*d* continuous with each other. Thus, there is no need to provide the connecting portion 58, enabling the size of the printer 10 in the Z axis direction to be made smaller by the height h1.

Inverting Unit

Explanation follows regarding the inverting unit 56 illustrated in FIG. 10 and FIG. 11. The inverting unit 56 is configured so as to be capable of being attached to and detached from the apparatus body 12, from the back face side (-Y direction side) of the apparatus body 12. In the present embodiment, the inverting unit 56 includes a second support section storing portion 56*b*, the inverting roller 26, the cover 38, and the second support section 44. When switching the second support section 44 from the pulled-out state to the stowed state, the first tray 44*a* to the third tray 44*c* of the second support section 44 are stowed inside the second support section storing portion 56*b* overlapped with each other in the Y axis direction.

The cover 38 is attached above the second support section storing portion 56*b* so as to be capable of pivoting. The inverting roller 26 is provided at the +Y direction side of the second support section storing portion 56*b*. Path forming members 60*a*, 60*b* are respectively provided in the +Z direction and −Y direction of the inverting roller 26. The path forming members 60*a*, 60*b* configure part of the medium transport path 22 in a state in which the inverting unit 56 is attached to the apparatus body 12, as illustrated in FIG. 5 and FIG. 6.

Returning to FIG. 2, in an attached state of the inverting unit 56, the inverting unit 56 is positioned on the −Z direction side of the medium feed apparatus 14 and configures part of an inverting path 62 of the medium transport path 22. An inverting path forming member 64 extends along the Y axis direction between the inverting unit 56 mounted to the apparatus body 12 in the Y axis direction, and the pair of transport rollers 28. The inverting path 62 of the medium transport path 22 is set as a path from the pair of transport rollers 28, through the inverting path forming member 64, around the inverting roller 26, and back to the pair of transport rollers 28.

Specifically, after the recording head 30 has recorded on the first face of a medium, the pair of transport rollers 28 are rotated in reverse such that the medium that has been recorded on the first face is returned back upstream in the transport direction along the inverting path forming member 64. Then, the medium which has been returned upstream is nipped between the inverting roller 26 and the following rollers 27*d*, 27*a*, 27*b*, and 27*c* in sequence so as to be bent around and inverted. The first face and the second face of the medium are thus inverted. Then, the medium is again fed to the position of the pair of transport rollers 28, and the recording head 30 records on the second face.

As illustrated in FIG. 11, the inverting path forming member 64 and a space at a lower side of the medium feed apparatus 14 are exposed when the inverting unit 56 is removed from the apparatus body 12. Thus, when the medium causes a jam in the inverting path 62, the medium stuck inside the inverting path 62 can be easily removed simply by removing the inverting unit 56 from the apparatus body 12.

Returning to FIG. 5, in a state in which the inverting unit 56 is mounted to the apparatus body 12, the connecting region W is configured overlapping, in the Y axis direction, at least a portion of a region occupied by the inverting path 62, and a portion of the path around the outer circumferential face of the inverting roller 26 in FIG. 5 from the following roller 27*d*, past the following roller 27*a*, and as far as the following roller 27*b*.

Modified Example of Present Embodiment

In the present embodiment, the medium feed apparatus 14 is applied to the printer 10 serving as an example of a recording apparatus. However, instead of this configuration, the medium feed apparatus 14 may be applied to an image reading apparatus such as a scanner.

The medium feed apparatus 14 includes the feeder roller 46 that feeds the medium, the first support section 42 that forms the first support face 42*a* supporting the medium fed by the feeder roller 46 such that the medium adopts an inclined orientation, and the second support section 44 that is positioned upstream of the first support face 42*a* in the feed direction and that forms the second support face 44*d* supporting the medium together with the first support face 42*a*. The second support face 44*d* is at a position set back from the first support face 42*a*, and the angle of inclination β of the second support face 44*d* from the lower end portion 44*e* to the upper end portion 44*f* is steeper than the angle of inclination α of the first support face 42*a*.

In the above configuration, the second support face 44*d* is at a position upstream of the first support face 42*a* in the feed direction, in a state in which a step is formed between the first support face 42*a* and the second support face 44*d*. Thus, when setting the high-rigidity second medium P2, the trailing edge P2E is not liable to contact the second support face 44*d*, enabling the inclined orientation of the medium to be an orientation following the first support face 42*a*, and thus enabling appropriate feeding to be achieved.

Note that the low-rigidity first medium P1 readily follows both the first support face 42*a* and the second support face 44*d*, and the entry angle of the first medium P1 downstream of the first support face 42*a* is appropriately defined by the first support face 42*a*, enabling good feeding results to be obtained.

Moreover, the angle of inclination of the second support face 44*d* is steeper than that of the first support face 42*a*, enabling the installation space needed for the apparatus rear side to be suppressed.

The configuration described above enables an appropriate medium orientation to be formed regardless of the rigidity of the medium, and enables the installation space of the printer 10 to be suppressed.

The second support face 44*d* is at a position that supports the first medium P1, and is at a position not contacted by the trailing edge P2E of the second medium P2 having higher rigidity and shorter length than the first medium P1.

In the above configuration, when feeding the second medium P2, the trailing edge P2E does not contact the second support face 44*d*, such that the trailing edge P2E does not follow the second support face 44*d* and the trailing edge P2E is not lifted up by the second support face 44*d*, which would cause the second medium P2 to adopt a steeper orientation than the angle of inclination α of the first support face 42*a*. The inclined orientation of the medium can accordingly be set to an orientation following the first support face 42*a*, such that the medium entry angle to the nipped position between the feeder roller 46 and the separation roller 48 becomes the preferred angle, enabling appropriate feeding to be realized. Note that even in cases in which the second medium P2 deforms such that the trailing edge P2E contacts the second support face 44*d*, a resulting change in the inclined orientation of the medium can be suppressed, enabling appropriate feeding to be realized.

The connecting face 50*b* is formed connecting the first support face 42*a* and the second support face 44*d* together. In this configuration, due to forming the connecting face 50*b* connecting the first support face 42*a* and the second support face 44*d* together, when setting a low-rigidity medium that is liable to warp, at least a portion of the connecting face 50*b* can be utilized in addition to the first support face 42*a* and the second support face 44*d* to support the medium, namely, the medium can supported even better.

The connecting face 50*b* is a face running along the Y axis direction, this being the horizontal direction. This configuration enables the connecting face 50*b* to support the medium even better.

The edge guides 54 which guide the edges of a medium form shapes straddling between the first support face 42*a* and the connecting face 50*b*. This configuration makes the edge guides 54 easier to grip, further improving ease of operation of the edge guides 54.

This configuration includes the cover 38 that opens/closes at least above the connecting face 50*b*. In a state in which the cover 38 is closed, the edge guides 54 restrict the cover 38 from flexing downward above the connecting face 50*b*. In this configuration, when an external force is applied from above the cover 38, the extension portions 54*a* contact the cover 38 above the connecting face 50*b*. This enables deformation of the cover 38 to be suppressed, enabling damage to the cover 38 to be suppressed and enabling an appropriate external appearance of the apparatus to be maintained.

The second support section 44 is provided so as to be capable of switching between the stowed state stowed at the apparatus back-face side (FIG. 2), and the pulled-out state pulled out from the stowed state to support the medium (FIG. 6). This configuration enables the printer 10 to be made small when in the stowed state.

The second medium P2 includes postcards. This configuration enables the inclined orientation of a postcard to be set to the appropriate angle when feeding postcards as the second medium P2, enabling appropriate feeding to be realized.

The printer 10 includes the recording head 30 configured to record on a medium, and the medium feed apparatus 14 configured to feed the medium toward the recording head 30.

The inverting path 62 that inverts a medium is provided at the lower side of the medium feed apparatus 14. The connecting region W between the first support face 42*a* and the second support face 44*d* and at least a portion of a region occupied by the inverting path 62 overlap with each other in the Y axis direction, this being the apparatus depth direction. This configuration enables an apparatus depth direction dimension to be suppressed in a configuration that includes the inverting path 62.

In the present embodiment, the first support face 42*a*, the second support face 44*d*, and the connecting face 50*b* according to the invention are applied to an ink jet printer, serving as an example of a recording apparatus; however, the first support face 42*a*, the second support face 44*d*, and the connecting face 50*b* according to the invention may be applied to other liquid ejecting apparatuses in general.

Liquid ejecting apparatuses here are not limited to recording apparatuses such as printers, copying machines, and fax machines which employ an ink jet recording head to discharge ink from the recording head to record on recording medium. Liquid ejecting apparatuses here also include apparatuses in which, instead of ink, liquid appropriate to the purpose is ejected onto an ejected-onto medium corresponding to the recorded medium from a liquid ejecting head corresponding to the ink jet recording head, and the liquid is adhered to the ejected medium.

Other than the recording head, examples of liquid ejecting heads include colorant ejecting heads employed in the manufacture of color filters for liquid crystal displays or the like, electrode material (conductive paste) ejecting heads employed to form electrodes of organic EL displays, field emission displays (FEDs), or the like, bioorganic matter ejecting heads employed in the manufacture of biochips, and sample ejecting heads employed as precision pipettes.

Note that the invention is not limited to the above embodiment, and obviously various modifications are possible within the scope of the invention as recited in the claims, and any such modifications are included in the scope of the invention.

The entire disclosure of Japanese Patent Application No. 2017-073820, filed Apr. 3, 2017 is expressly incorporated by reference herein.

What is claimed is:

1. A medium feed apparatus comprising:

a feed unit that feeds a medium;

a first support section that forms a first support face supporting a medium fed by the feed unit such that the medium adopts an inclined orientation; and a second support section that is positioned upstream of the first support face in a feed direction, and that forms a second support face supporting the medium together with the first support face;

the second support face being at a position set back from the first support face, and an angle of inclination of the second support face from a lower end portion to an upper end portion of the second support face being larger than an angle of inclination of the first support face, wherein a connecting face is formed connecting the first support face and the second support face together, wherein an edge guide that guides an edge of a medium forms a shape straddling between the first support face and the connecting face.

2. The medium feed apparatus according to claim 1, wherein:

the second support face is at a position contacted by a trailing edge of a first medium when the first medium is placed on the first support face and at a position not contacted by the trailing edge of a second medium when the second medium is placed; and a length of the first medium in the feed direction is greater than or equal to a feed direction length of A4 size as defined in ISO 216, and a length of the second medium in the feed direction is less than or equal to a feed direction length of A6 size as defined in ISO 216.

3. The medium feed apparatus according to claim 1, wherein the connecting face is a face running along a horizontal direction.

4. The medium feed apparatus according to claim 1, further comprising a cover that opens/closes at least above the connecting face, wherein in a state in which the cover is closed, the edge guide restricts the cover from flexing downward above the connecting face.

5. The medium feed apparatus according to claim 1, wherein the second support section is provided to be capable of switching between a stowed state stowed at an apparatus back face side, and a pulled-out state pulled out from the stowed state to support a medium.

6. A recording apparatus comprising:

a recording unit configured to perform recording on a medium; and the medium feed apparatus according to claim 1 configured to feed a medium toward the recording unit.

7. The recording apparatus according to claim 6, further comprising an inverting path that is disposed at a lower side of the medium feed apparatus and that inverts a medium, wherein a connecting region between the first support face and the second support face and at least a portion of a region occupied by the inverting path overlap with each other in an apparatus depth direction.

* * * * *